US009618018B2

(12) United States Patent
An et al.

(10) Patent No.: US 9,618,018 B2
(45) Date of Patent: Apr. 11, 2017

(54) HYDRAULIC SYSTEM FOR CONSTRUCTION EQUIPMENT

(71) Applicant: DOOSAN INFRACORE CO., LTD., Incheon (KR)

(72) Inventors: Min Ha An, Seoul (KR); Woo Yong Jung, Seoul (KR); Yong Lak Cho, Incheon (KR); A Reum Seo, Incheon (KR); Dal Sik Jang, Seoul (KR); Kwang Ho Lim, Seoul (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 90 days.

(21) Appl. No.: 14/777,658

(22) PCT Filed: Mar. 26, 2014

(86) PCT No.: PCT/KR2014/002562

§ 371 (c)(1),
(2) Date: Sep. 16, 2015

(87) PCT Pub. No.: WO2014/157946

PCT Pub. Date: Oct. 2, 2014

(65) Prior Publication Data

US 2016/0102686 A1 Apr. 14, 2016

(30) Foreign Application Priority Data

Mar. 26, 2013 (KR) ..... 10-2013-0032079

(51) Int. Cl.
*F15B 11/10* (2006.01)
*E02F 9/22* (2006.01)
(Continued)

(52) U.S. Cl.
CPC ..... *F15B 11/10* (2013.01); *E02F 9/2217* (2013.01); *E02F 9/2228* (2013.01);
(Continued)

(58) Field of Classification Search
CPC F15B 11/04; F15B 21/00; F15B 21/14; F15B 11/028; F15B 13/02; F15B 19/00; F15B 13/042; F15B 11/05
(Continued)

(56) References Cited

U.S. PATENT DOCUMENTS 4,410,057 A * 10/1983 Johnson ..... B62D 5/32 180/406
5,299,420 A * 4/1994 Devier ..... E02F 9/22 137/596.16
(Continued)

FOREIGN PATENT DOCUMENTS

JP 2002174202 A 6/2002
JP 2010101446 A 5/2010
(Continued)

OTHER PUBLICATIONS

International Search Report for PCT/KR2014/002562 dated Jul. 7, 2014, citing the above reference(s).

*Primary Examiner* — Thomas E Lazo
(74) *Attorney, Agent, or Firm* — Hauptman Ham, LLP

(57) ABSTRACT

The present disclosure relates to a hydraulic system for construction equipment, and more particularly, to a hydraulic system, in which an actuator is controlled by a pump/motor. The hydraulic system for construction equipment according to the present disclosure includes logic valves in first and second hydraulic lines provided to an actuator, respectively, and when it is desired to operate the actuator in a state where an operation of the actuator is stopped by closing the logic valves, a pressure difference may be resolved by increasing pressure in sections of a pump/motor and the logic valves in advance even if a load is applied to the actuator, and thus the actuator may implement a desired
(Continued)

operation without being affected by the load. That is, it is possible to improve operation controllability of the actuator.

10 Claims, 7 Drawing Sheets

(51) Int. Cl.

| | |
|---|---|
| ***F15B 11/17*** | (2006.01) |
| ***F15B 21/14*** | (2006.01) |
| ***F15B 13/042*** | (2006.01) |
| *F15B 7/00* | (2006.01) |

(52) U.S. Cl.
CPC ..... *E02F 9/2289* (2013.01); *E02F 9/2292* (2013.01); *E02F 9/2296* (2013.01); *F15B 11/17* (2013.01); *F15B 13/042* (2013.01); *F15B 21/14* (2013.01); *F15B 7/006* (2013.01); *F15B 2211/20523* (2013.01); *F15B 2211/20546* (2013.01); *F15B 2211/20561* (2013.01); *F15B 2211/20569* (2013.01); *F15B 2211/20576* (2013.01); *F15B 2211/27* (2013.01); *F15B 2211/3057* (2013.01); *F15B 2211/30515* (2013.01); *F15B 2211/30595* (2013.01); *F15B 2211/31529* (2013.01); *F15B 2211/327* (2013.01); *F15B 2211/613* (2013.01); *F15B 2211/625* (2013.01); *F15B 2211/6346* (2013.01); *F15B 2211/7142* (2013.01); *F15B 2211/88* (2013.01)

(58) Field of Classification Search
USPC ..... 60/430, 476
See application file for complete search history.

(56) References Cited

U.S. PATENT DOCUMENTS

| | | | | |
|---|---|---|---|---|
| 6,886,332 | B2 * | 5/2005 | Kubinski | F15B 7/08 60/475 |
| 2007/0205026 | A1 * | 9/2007 | Lee | E02F 9/2242 180/6.48 |
| 2012/0260641 | A1 * | 10/2012 | Opdenbosch | E02F 9/2217 60/327 |

FOREIGN PATENT DOCUMENTS

| | | | |
|---|---|---|---|
| JP | 2011231823 | A | 11/2011 |
| KR | 100790364 | B1 | 1/2008 |
| KR | 20120072731 | A | 7/2012 |

* cited by examiner

HYDRAULIC SYSTEM FOR CONSTRUCTION EQUIPMENT

FIELD OF THE DISCLOSURE

The present disclosure relates to a hydraulic system for construction equipment, and more particularly, to a hydraulic system, in which an actuator is controlled by a pump/motor.

BACKGROUND OF THE DISCLOSURE

In general, a hydraulic system for construction equipment includes an engine generating power, a main hydraulic pump driven by receiving the power of the engine to discharge a working fluid, a plurality of actuators performing an operation, an operating unit operated to actuate the actuator of a desired operating device, and a main control valve distributing the working fluid required by the operation of the operating unit to a corresponding actuator.

In the operating unit, a requirement command is formed according to an operation displacement operated by an operator, and a flow quantity of working fluid discharged from the hydraulic pump is controlled by the requirement command. The operating unit may be, for example, a joystick and a pedal.

Further, in order to make the main hydraulic pump discharge the working fluid, rotation torque of the pump needs to be varied. The torque is referred to as pump torque. The pump torque T is calculated by multiplying a pump capacity and a pressure P formed in the working fluid. The pump capacity is a flow quantity of working fluid discharged per one rotation of a shaft of the pump.

In the aforementioned hydraulic system known in the art, the hydraulic pump distributes a working fluid discharged from one or two main pumps to each actuator under control of the main control valve. That is, the pressure of the working fluid discharged from the main control valve is inevitably lost while the working fluid passes through the main control valve and various valves, such that energy efficiency is low.

SUMMARY

Accordingly, a technical object to be solved by the present disclosure is to provide a hydraulic system for construction equipment, which directly controls a corresponding actuator by a pump/motor, thereby improving energy efficiency.

Another technical object to be solved by the present disclosure is to provide a hydraulic system for construction equipment, which prevents the actuator from being operated in an undesired direction due to the load when the actuator is operated in a state where an operation of the actuator is stopped, even though a load is applied to an actuator, thereby improving controllability and stability.

In order to achieve the aforementioned object, an exemplary embodiment of the present disclosure provides a hydraulic system for construction equipment, including: a pump/motor 40 serving as both pump and motor; an actuator 70 provided with a first port 71 and a second port 72, and operated by a working fluid provided from the pump/motor 40; first and second hydraulic lines 111 and 112 connected with the first port 71 and the pump/motor 40; third and fourth hydraulic lines 121 and 122 connected with the second port 71 and the pump/motor 40; a first logic valve 110 disposed in the first hydraulic line 111 and the second hydraulic line 112; and a second logic valve 120 disposed in the third hydraulic line 121 and the fourth hydraulic line 122, in which when a first pressure of a higher pressure side between the first port 71 and the second port 72 is larger than a second pressure of the pump/motor 40, the pump/motor 40 is operated from a time point, at which an operating unit is operated, so that the first pressure and the second pressure are controlled to be the same before the first and second logic valves 110 and 120 are opened.

When a first direction, in which a load is applied to the actuator 70, and a second direction, in which the actuator 70 is desired to be operated, are defined, and the first direction corresponds to the second direction, an opening time point of the first and second logic valves 110 and 120 may be controlled to be advanced compared to a case where the first direction is different from the second direction.

When the pump/motor 40 is operated to increase the second pressure, a flow quantity of the working fluid may be controlled to be discharged at a maximum value for a pressure/flow quantity compensation time t1.

When the pump/motor 40 is operated to increase the second pressure, a leakage compensation flow quantity may be controlled to be discharged at a maximum value for compensating for leakage of the working fluid.

The hydraulic system for construction equipment may further include relief valves 60 in the second and fourth hydraulic lines so that the second pressure is maintained at set pressure.

In order to achieve the aforementioned object, another exemplary embodiment of the present disclosure provides a hydraulic system for construction equipment, including: a pump/motor 40 serving as both a pump and a motor; an actuator 70, of which an inlet port and an outlet port are connected with the pump/motor 40 through a hydraulic line; first and second logic valves 110 and 120 installed on the hydraulic line so as to open or close the hydraulic line; and a control unit 200 configured to control the first and second logic valves 110 and 120 to be opened or closed according to an operation signal for the actuator 70, wherein when the control unit 200 operates the actuator 70 in an opposite direction to a direction, in which a load is applied to the actuator 70, the control unit 200 delays an opening of the first and second logic valves 110 and 120 until pressure is compensated in the hydraulic line between the pump/motor 40 at a hydraulic pressure supply side and the first logic valve 110 or the second logic valve 120.

When the control unit 200 operates the actuator 70 in the same direction as a direction, in which a load is applied to the actuator 70, the control unit 200 may control an opening delay time of the first and second logic valves 110 and 120 to be shorter than that of a case where the control unit 200 operates the actuator 70 in the opposite direction to the direction.

An opening delay time of the first and second logic valves 110 and 120 may be up to a time at which pressure of the hydraulic line between the pump/motor 40 at a hydraulic pressure supply side and the first logic valve 110 or the second logic valve 120 is the same as pressure of the hydraulic line between the first logic valve 110 or the second logic valve 120 and the actuator 70.

Pressure of the hydraulic line between the pump/motor 40 and the first logic valve 110 or the second logic valve 120 may be compensated by hydraulic pressure discharged from the pump/motor 40.

The hydraulic system for construction equipment may further include relief valves 60 on the hydraulic lines connecting the first and second logic valves 110 and 120 and the actuator 70 so as to maintain set pressure.

In the hydraulic system for construction equipment according to the exemplary embodiment of the present disclosure configured as described above, a main cause of pressure loss of a working fluid is removed by excluding a main control valve, which is provided in the hydraulic system in the related art, thereby improving fuel efficiency.

Further, the hydraulic system for construction equipment according to the exemplary embodiment of the present disclosure includes the logic valves in the first and second hydraulic lines provided to the actuator, respectively, and when it is desired to operate the actuator in a state where an operation of the actuator is stopped by a closing of the logic valves, a pressure difference may be resolved by increasing pressure in sections of the pump/motor and the logic valves in advance even if a load is applied to the actuator, and thus the actuator may implement a desired operation without being affected by the load. That is, it is possible to improve operation controllability of the actuator.

Figure 1:
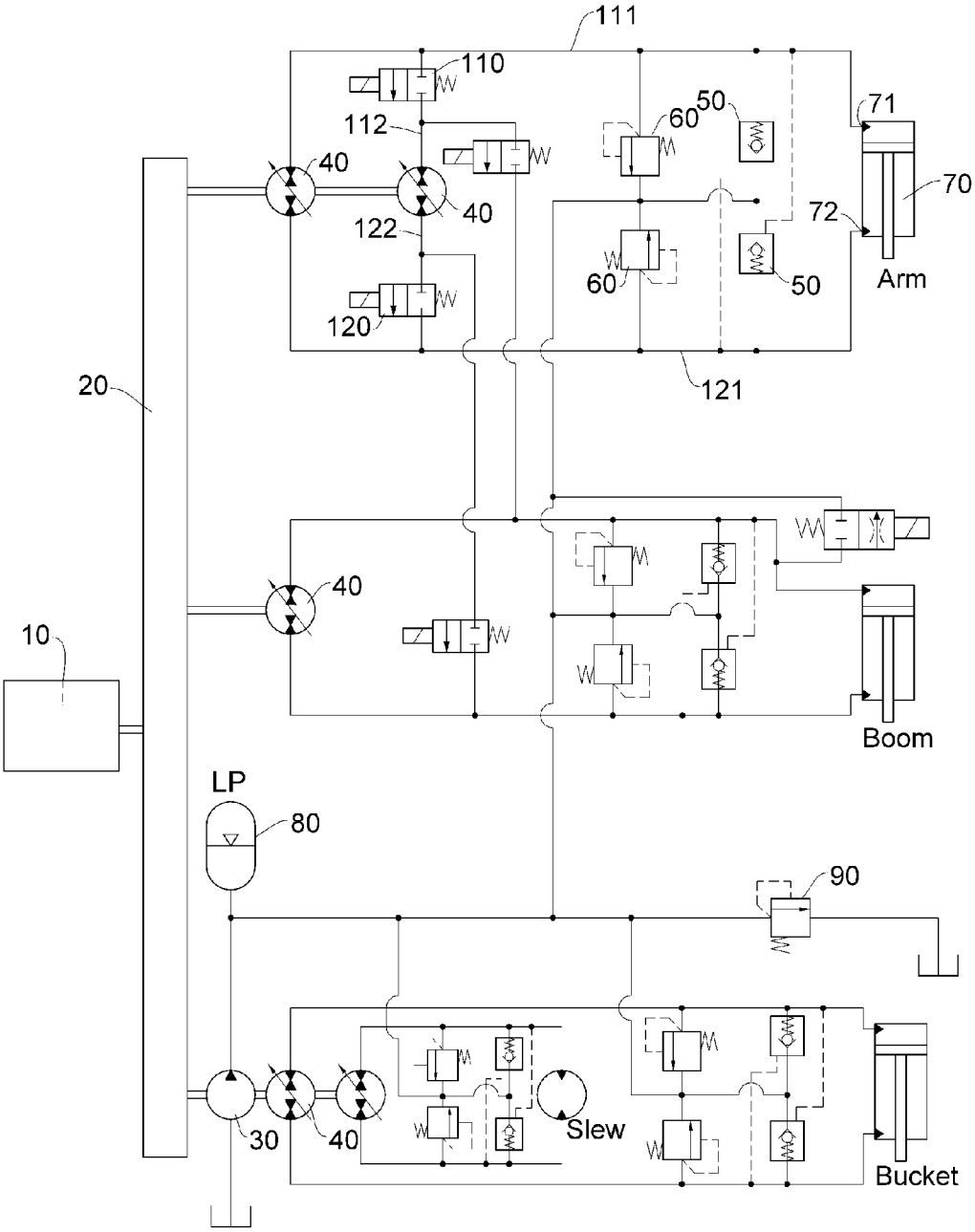
FIG. 1 is a diagram of a hydraulic circuit for describing a hydraulic system for construction equipment.

| Description of Main Reference Numerals of the Drawings | |
|---|---|
| 10: Engine | 20: Power distributing unit |
| 30: Charging Pump | 40: Pump/motor |
| 50: Check valve unit | 60: Relief valve |
| 70: Actuator | 71, 72: First and second ports |
| 80: Accumulator | 90: Charging relief valve |
| 110, 120: First and second logic valves | |
| 111, 112, 121, 122: First to fourth hydraulic lines | |
| 200: Control unit | 210: Joystick |

DETAILED DESCRIPTION

Advantages and characteristics of the present disclosure, and a method of achieving the advantages and characteristics will be clear with reference to an exemplary embodiment described in detail together with the accompanying drawings.

Hereinafter, an exemplary embodiment of the present disclosure will be described in detail with reference to the accompanying drawings. It should be appreciated that the exemplary embodiment, which will be described below, is illustratively described for helping the understanding of the present disclosure, and the present disclosure may be modified to be variously carried out differently from the exemplary embodiment described herein. In the following description of the present disclosure, a detailed description and a detailed illustration of known configurations or functions incorporated herein will be omitted when it is determined that the detailed description may make the subject matter of the present disclosure unclear. Further, in order to help the understanding of the present disclosure, the accompanying drawings are not illustrated according to an actual scale, but sizes of some constituent elements may be exaggerated and illustrated.

Meanwhile, the terms used in the description are defined considering the functions of the present disclosure and may vary depending on the intention or usual practice of a producer. Therefore, the definitions should be made based on the entire contents of the present specification.

Like reference numerals indicate like elements throughout the specification.

A hydraulic system for construction equipment in the related art has a configuration, in which the main pump discharges a working fluid of one or two hydraulic pumps, and distributes the working fluid discharged from the hydraulic pump to each actuator by a main control valve MCV. However, in the hydraulic system provided with the main control valve, pressure loss is generated while the working fluid passes through the main control valve, so that energy efficiency is low.

As a hydraulic system for improving energy efficiency, a hydraulic system, in which an independent pump/motor is provided in each actuator, and a corresponding actuator is controlled by controlling the pump/motor, has been developed.

The hydraulic system is operated by receiving an oil quantity from the bi-directional type pump/motor of each actuator, and there is no separate metering valve (control valve), so that there is no resistance when a working fluid passes through various valves and thus there is little pressure loss of the working fluid, and as a result, energy efficiency for actually operating the actuator is high.

A "hydraulic system" described below means a hydraulic system, in which an independent bi-directional pump/motor is allocated to each actuator, and will be described with reference to FIG. 1. FIG. 1 is a diagram of a hydraulic circuit for describing a hydraulic system for construction equipment.

As illustrated in FIG. 1, a hydraulic system includes an engine 10 generating power, a power distributing unit 20 distributing the power generated by the engine 10 to a plurality of pumps/motors 40, and an actuator 70 operated by a working fluid discharged from each pump/motor 40.

The pump/motor 40 is a hydraulic constituent element serving as both hydraulic pump and hydraulic motor. That is, the pump/motor 40 is used as a hydraulic pump when desiring to operate an actuator 70, and by contrast, the pump/motor 40 is used as a hydraulic motor when a working fluid flows by kinetic energy or inertia energy of the actuator 70.

When the pump/motor 40 is used as the hydraulic motor, it may assist with the torque driven by the engine 10. Particularly, power of the engine 10 rotates a shaft of each pump/motor 40 by the power distributing unit 20, and when the pump/motor 40 is operated as the hydraulic motor by potential energy/inertia energy generated by the actuator 70, the shaft of the pump/motor 40 adds rotational force in a direction, in which the shaft of the pump/motor 40 has rotated by the power of the engine, so that there is an effect in that a load of the engine is reduced.

In the meantime, a charging pump 30 is provided at one side of the plurality of pumps/motors 40. The charging pump 30 discharges a working fluid and stores energy in an accumulator 80. Here, the energy may be pressure energy applied to the working fluid.

In the aforementioned hydraulic system, when an operating unit is operated, a capacity command controlling the actuator 70 is generated by the operation of the operating unit. The capacity command is provided to a pump/motor control unit to control the pump/motor 40.

Further, a working fluid charging hydraulic circuit (charging system) is introduced in the hydraulic system. The working fluid charging hydraulic circuit includes the charging pump 30, a check valve unit 50, a relief valve 60, the accumulator 80, and a charging relief valve 90.

The charging pump 30 discharges the working fluid by the power of the engine. The working fluid discharged from the charging pump 30 is provided to the accumulator 80.

The check valve unit 50 serves to enable the working fluid to flow from the accumulator 80 to the pump/motor 40 or the actuator 70 and prevent the working fluid from flowing backward.

The relief valve 60 maintains pressure set within the working fluid charging hydraulic circuit, and is opened when higher pressure than the set pressure is formed to discharge some of the working fluid to the accumulator 80.

The accumulator 80 stores the working fluid, and as previously described, stores pressure energy applied to the working fluid.

The charging relief valve 90 is opened when pressure of the charged working fluid is formed to be higher than the set pressure to uniformly maintain the set pressure within the working fluid charging hydraulic circuit.

The aforementioned hydraulic system directly controls the actuator 70 by the pump/motor 40, so that it is possible to remarkably decrease loss of hydraulic pressure, but construction equipment has a spatial limit, so that there is a limit in increasing the number of pumps/motors 40. Accordingly, a circuit may be provided so that the plurality of actuators 70 may share a specific pump/motor 40. As described above, a logic valve for controlling, such as blocking or connecting, a hydraulic line, through which the working fluid flows, when the plurality of actuators desires to share the specific pump/motor 40 is used.

Hereinafter, a pump/motor control hydraulic circuit according to a Comparative Example in the hydraulic system for construction equipment will be described with reference to FIGS. 2 and 3.

Figure 2:
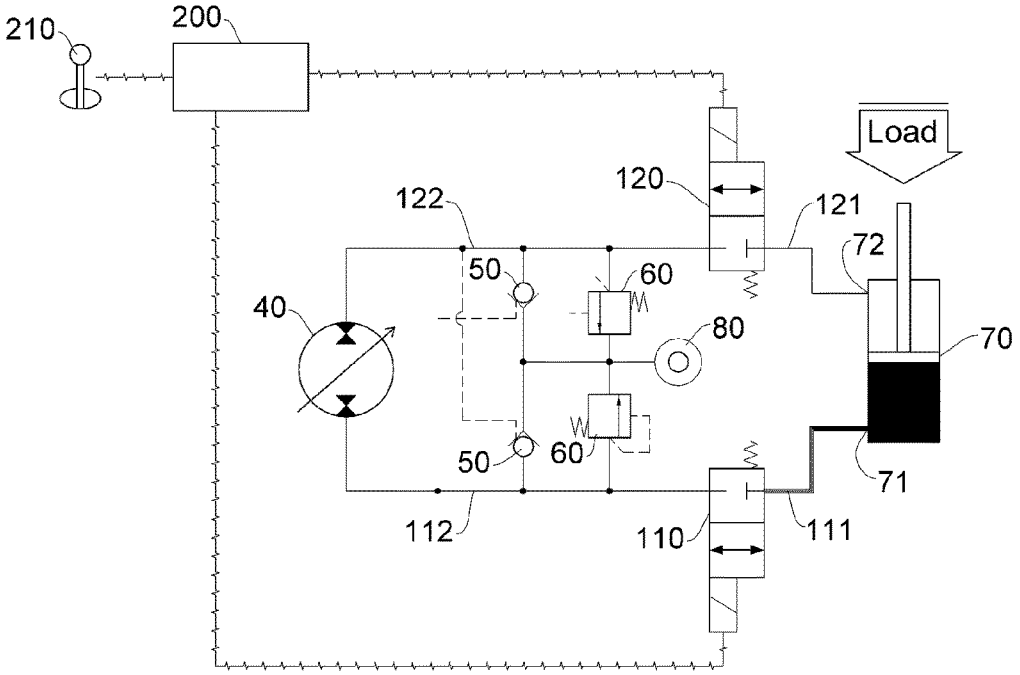
FIGS. 2 and 3 are diagrams for describing a pump/motor control hydraulic circuit according to a Comparative Example in the hydraulic system for construction equipment.
Figure 3:
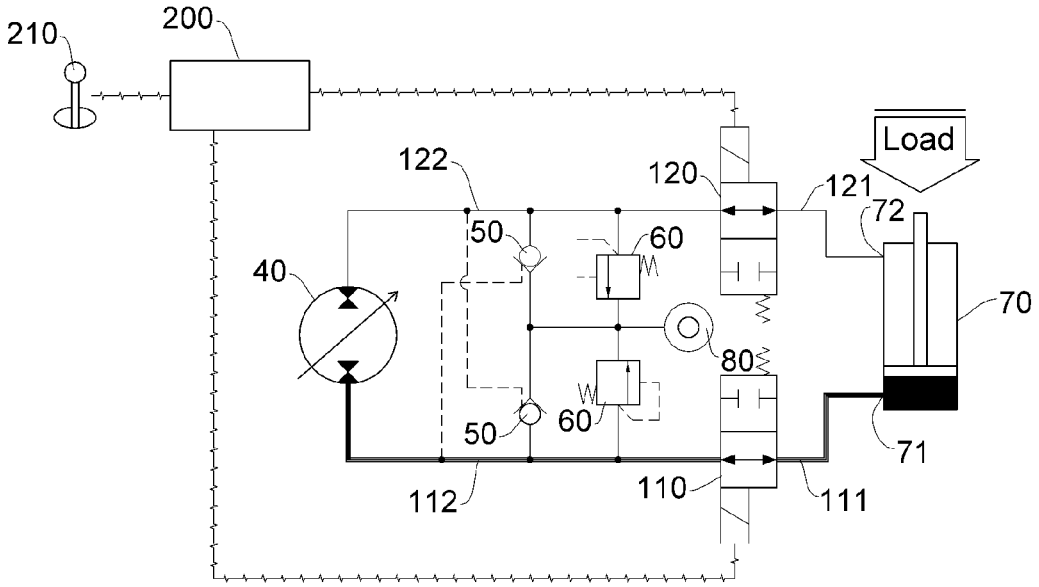

FIGS. 2 and 3 are diagrams for describing the pump/motor control hydraulic circuit according to the Comparative Example in the hydraulic system for construction equipment.

As illustrated in FIGS. 2 and 3, a first port 71 is formed at a cylinder head of the actuator 70, and a second port 72 is formed at a rod of the actuator 70. Further, working fluid inlet/outlet ports are formed at both sides of the pump/motor 40.

First and second hydraulic lines 111 and 112 are connected to the first port 71 and the working fluid inlet/outlet ports of the pump/motor 40. A first logic valve 110 is provided in the first hydraulic line 111 and the second hydraulic line 112.

Similarly, third and fourth hydraulic lines 121 and 122 are connected to the second port 72 and the working fluid inlet/outlet ports of the pump/motor 40. A second logic valve 120 is provided in the third hydraulic line 121 and the fourth hydraulic line 122.

As illustrated in FIG. 2, the first and second logic valves 110 and 120 according to the Comparative Example are maintained in a closed state in a state where an operation of the actuator 70 is stopped. Accordingly, a flow of the working fluid is blocked, and the actuator 70 is maintained in the operation stopped state.

Further, as illustrated in FIG. 3, the first and second logic valves 110 and 120 are opened when the actuator 70 is operated. Accordingly, the actuator 70 is operated by the working fluid discharged from the pump/motor 40. In the meantime, when the actuator 70 is a linear type, the actuator 70 linearly moves in a direction, in which the rod is extended or contracted. When the actuator 70 is a rotary type, in which the shaft of the actuator 70 is rotated, the shaft rotates in a clockwise direction or a counterclockwise direction.

However, in the pump/motor control hydraulic circuit according to the Comparative Example, when the actuator 70 supports a load in the operation stopped state, the first and second logic valves 110 and 120 are opened when it desires to operate the actuator 70, and a problem may be incurred at a moment of the opening of the first and second logic valves 110 and 120. The problem will be further described below.

As illustrated in FIG. 2, when a load is applied in the actuator 70 in a direction in which the rod is contracted, high pressure is formed in the working fluid in the first hydraulic line 111 from the first port 71 to a front end of the first logic valve 110.

By contrast, relatively lower pressure than the high pressure is formed in the second hydraulic line 112 from the first logic valve 110 to the pump/motor 40.

That is, even if an operator intends to operate the actuator 70 in a direction, in which the rod is extended, the working fluid may momentarily flow from the actuator 70 to the pump/motor 40 by a pressure difference of the working fluid at the moment of the opening of the first and second logic valves 110 and 120. Accordingly, there is a problem in that the actuator 70 may be operated in a direction in which the rod of the actuator 70 is contracted, regardless of the intention of the operator.

In the meantime, the pump/motor control hydraulic circuit according to the Comparative Example may be dangerous as pressure of the high pressure side of the actuator 70 becomes high, and for example, when a direction, in which the actuator 70 is desired to be operated, is the same as a direction, in which the load is applied, the actuator 70 may be operated at an excessively high speed, so that controllability may deteriorate.

Figure 4:
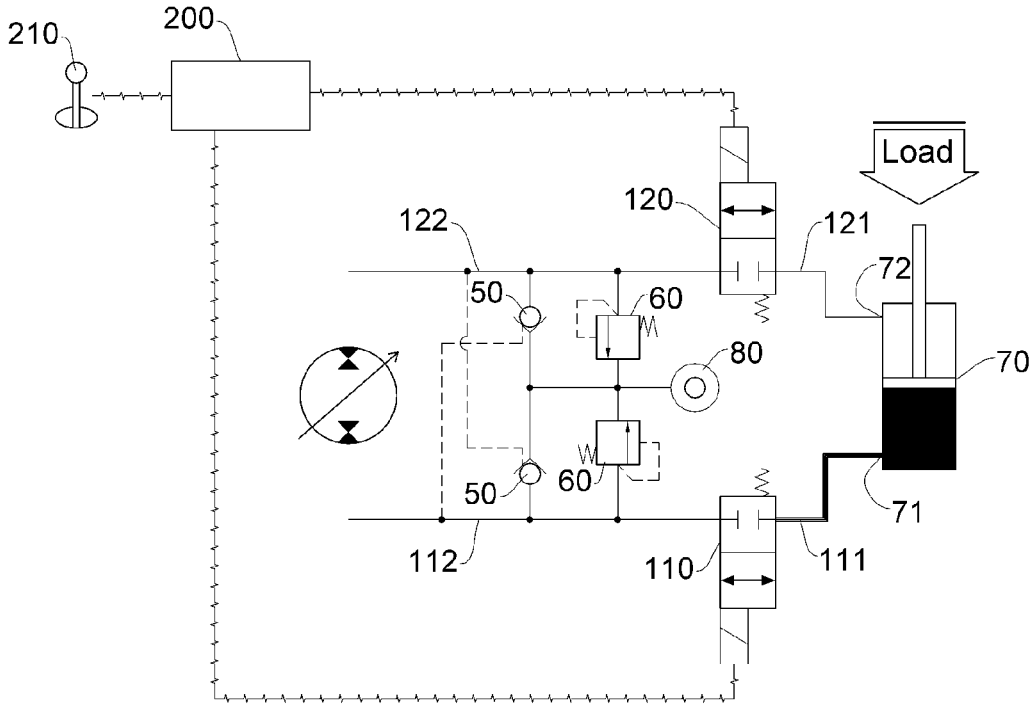
FIGS. 4 to 6 are diagrams for describing a pump/motor control hydraulic circuit according to an exemplary embodiment of the present disclosure in the hydraulic system for construction equipment.
Figure 5:
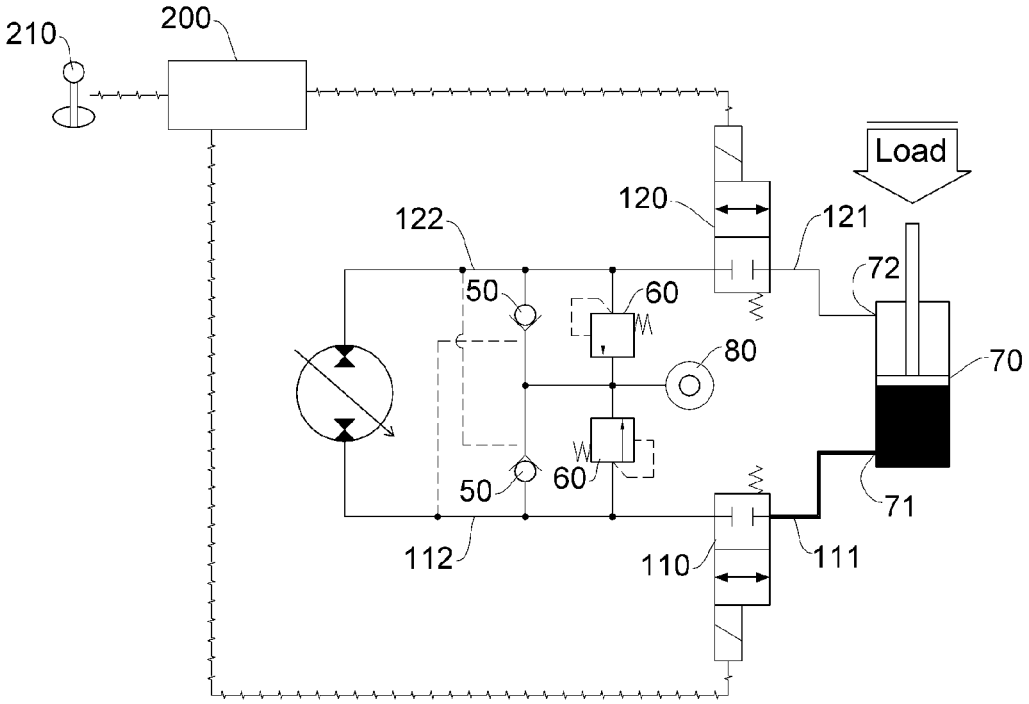
Figure 6:
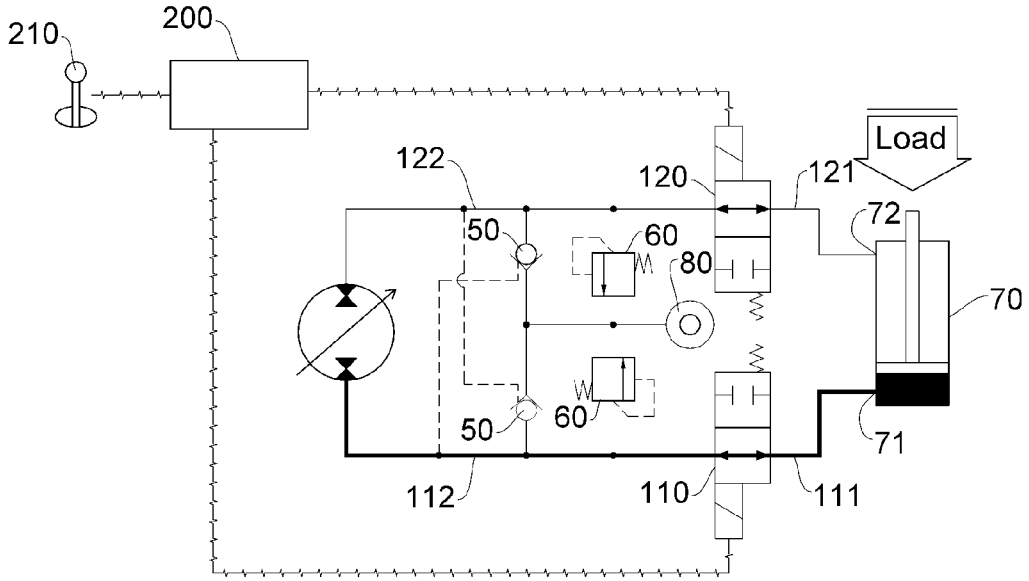

Hereinafter, a pump/motor control hydraulic circuit according to an exemplary embodiment of the present disclosure will be described with reference to FIGS. 4 to 6. FIGS. 4 to 6 are diagrams for describing a pump/motor control hydraulic circuit according to an exemplary embodiment of the present disclosure in the hydraulic system for construction equipment.

The configuration of the pump/motor control hydraulic circuit according to the exemplary embodiment of the present disclosure is the same as that of the Comparative Example, but is different in control of the pump/motor control hydraulic circuit. More particularly, pressure of the first hydraulic line 111 is adjusted to be the same as or similar to pressure of the second hydraulic line 112 before or after the first and second logic valves 110 and 120 are opened by operating the operating unit so that the actuator 70 is operated. As described above, the pump/motor control hydraulic circuit according to the exemplary embodiment of the present disclosure performs a pre-pressurization action of increasing pressure before or after the first and second logic valves 110 and 120 are opened.

In the meantime, the hydraulic circuit for construction equipment according to the exemplary embodiment of the present disclosure includes a control unit 200. The control unit 200 receives an operation signal generated by operating a joystick 210 to control the first and second logic valves 110 and 120 to be opened or closed. The operation signal may be generated when the joystick 210 is operated in order to control the actuator 70.

FIG. 4 illustrates an example, in which an operation stopped state of the actuator 70 is maintained in a state where a load is applied to the actuator 70.

That is, high pressure is formed in the first hydraulic line 111 from the first port 71 to the first logic valve 110. By contrast, relatively low pressure is maintained in the second hydraulic line 112 from the first logic valve 110 to the pump/motor 40.

FIG. 5 is a diagram illustrating a moment of operating the actuator 70 by operating the joystick 210 by the operator. As illustrated in FIG. 5, the pump/motor 40 is operated to form pressure in the second hydraulic line 112. The formed pressure may be pressure that is the same as or similar to the pressure formed in the first hydraulic line 111. That is, the working fluid flows to the second hydraulic line 112 by the action of the pump/motor 40 before or after the first and second logic valves 110 and 120 are opened.

When the control unit 200 operates the actuator 70 in an opposite direction to a first direction, in which the load is applied to the actuator 70, the control unit 200 delays an opening of the first and second logic valves 110 and 120 until pressure is compensated in the hydraulic line between the pump/motor 40 at the hydraulic pressure supply side and the first logic valve 110 or the second logic valve 120.

In the meantime, operation reactivity may deteriorate as a time t2 from a time point of the operation of the joystick 210 to a time point of the opening of the first and second logic valves 110 and 120 is long, so that it is preferable to compensate for pressure as soon as possible. To this end, a command of the pressure compensation flow quantity is set to a maximum value or a considerably high value, and a pressure/flow quantity compensation time t1 may be set to be short.

Further, when pressure of the pump/motor 40 is high, there is a concern that leakage occurs, so that the control unit 200 may further execute a flow quantity compensation command to compensate for flow quantity leakage. This may be set with data values represented in Table 1 below. Data represented in Table 1 are values suggested for helping understanding of the exemplary embodiment of the present disclosure and do not limit the scope of the present disclosure, and a time and a numerical value of a flow quantity may be varied according to a size of set pressure.

TABLE 1

| Actuator pressure | Operation speed of joystick | Pressure and flow quantity compensation time | Logic valve opening time | Maximum pressure compensation flow quantity | Maximum leakage compensation flow quantity |
|---|---|---|---|---|---|
| 100 bar | Low | 20 ms | 40 ms | 60% | 10% |
| 300 bar | Low | 45 ms | 40 ms | 100% | 25% |
| 100 bar | High | 20 ms | 15 ms | 80% | 10% |
| 300 bar | High | 30 ms | 20 ms | 100% | 30% |

FIG. 6 is a diagram illustrating an example, in which the first and second logic valves 110 and 120 are opened, so that the actuator 70 is controlled by a working fluid discharged from the pump/motor 40.

The pressure of the first hydraulic line 111 has corresponded to the pressure of the second hydraulic line 112 before, so that even though the first and second logic valves 110 and 120 are opened, the pressures of the working fluid in both hydraulic lines have similar levels, and thus the working fluid does not move in a predetermined direction, and the actuator 70 is operated in a direction, in which the working fluid is discharged from the pump/motor 40.

In the meantime, when the first direction, in which the actuator 70 is desired to be operated by operating the joystick 210, is the same as a second direction, in which the load is applied, an operation speed of the actuator 70 may be improved by rapidly operating the joystick 210.

That is, when the first direction is the same as the second direction, an opening time point of the first and second logic valves 110 and 120 may be advanced and set to be advanced compared to the case where the first direction is different from the second direction.

In the meantime, when an operation speed of the joystick 210 is measured, and the operation of the joystick 210 is rapid, a compensation for pressure of the pump/motor 40 may be partially adjusted by using force of the load. This may be performed only when the direction of the load corresponds to the operation direction of the joystick 210.

The direction of the application of the load may be recognized by a pressure value detected by a pressure sensor provided in the first and second ports 71 and 72 of the actuator 70. That is, when pressure of the first port 71 is larger than pressure of the second port 72, it may be recognized that the load is applied in the direction, in which the rod is contracted, as illustrated in FIG. 4.

In the meantime, in the exemplary embodiment, it is described that high pressure is formed at the first port 71, but in contrast to this, it may be understood that when high pressure is formed at the second port 72, high pressure is formed in the third hydraulic line 121. That is, an action when high pressure is formed in the third hydraulic line 121 is controlled by the same form as the action when high pressure is formed in the first hydraulic line 111.

Further, when pressure of the second hydraulic line 112 is maintained to be high with the pressure of the working fluid by discharging the working fluid from the pump/motor 40 before the first and second logic valves 110 and 120 are opened, high pressure may be generated in the pump/motor 40, but stable pressure of the pump/motor control hydraulic circuit may be maintained by additionally providing a relief valve. Further, excessive high pressure is suppressed by the relief valve, thereby preventing leakage.

Figure 7:
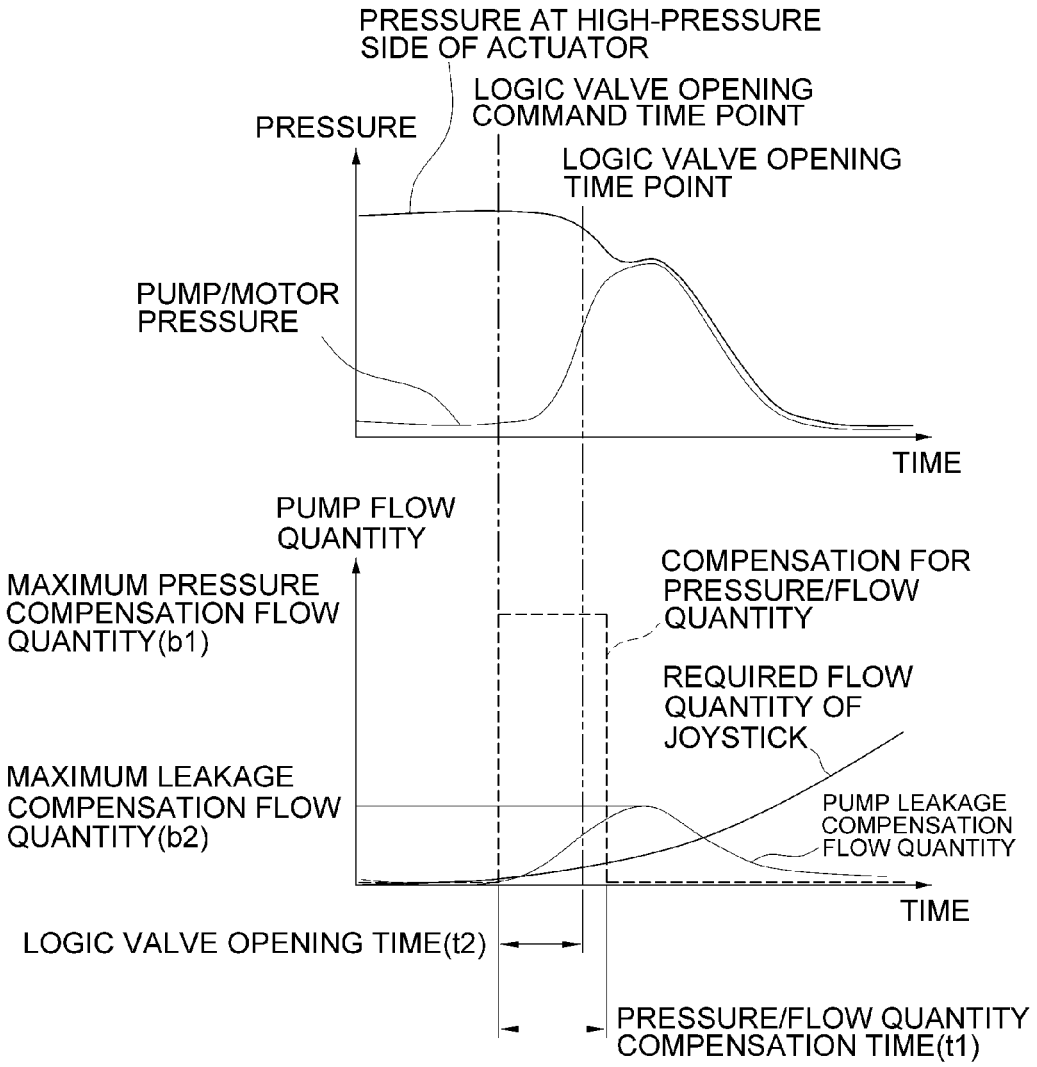
FIG. 7 is a diagram illustrating a development of a flow quantity and pressure of a pump under control of the pump/motor of the hydraulic system according to the exemplary embodiment of the present disclosure.

FIG. 7 is a diagram for describing a development of a flow quantity and pressure of a pump under control of the pump/motor of the hydraulic system according to the exemplary embodiment of the present disclosure.

As illustrated in FIG. 7, in a state where pressure is formed at a high pressure side of the actuator 70, pressure of the pump/motor 40 may be relatively low.

An opening command of the first and second logic valves 110 and 120 is generated from an operation moment of the joystick 210, and a pressure compensation flow quantity is discharged from the pump/motor 40 for the pressure/flow quantity compensation time t1 from the generation time point of the logic valve opening command, so that the pressure and the flow quantity are compensated. In this case, the pressure is compensated at a maximum pressure compensation flow quantity b1 of the maximum value as the pressure compensation value, as described above.

Further, the opening command of the first and second logic valves 110 and 120 is generated from the operation moment of the joystick 210. The first and second logic valves 110 and 120 are completely opened when the logic valve opening time t2 elapses.

The compensation is performed at a maximum leakage compensation flow quantity b2 by a time immediately after the first and second logic valves 110 and 120 are completely opened.

As described above, the pump/motor control hydraulic circuit of the hydraulic system for construction equipment according to the exemplary embodiment of the present disclosure may stably control the actuator 70 by forming pressure at the same level as that of high pressure formed by a load within the pump/motor control hydraulic circuit even though the load is applied to the actuator 70.

In the hydraulic system for construction equipment according to the exemplary embodiment of the present disclosure configured as described above, a main cause of pressure loss of a working fluid is excluded by excluding a main control valve, which is provided in the hydraulic system in the related art, thereby improving fuel efficiency.

Further, the hydraulic system for construction equipment according to the exemplary embodiment of the present disclosure includes the first and second logic valves 110 and 120 in the hydraulic lines 111, 112, 121, and 122 provided to the actuator 70, respectively, and when it is desired to operate the actuator 70 in a state where an operation of the actuator 70 is stopped by the closing of the first and second logic valves 110 and 120, a pressure difference may be resolved by increasing pressure in sections of the pump/motor 40 and the first and second logic valves 110 and 120 even if the load is applied to the actuator 70 in advance, and thus the actuator 70 may implement a desired operation without being affected by the load. That is, operation controllability of the actuator may be improved.

The exemplary embodiments of the present disclosure have been described with reference to the accompanying drawings, but those skilled in the art will understand that the present disclosure may be implemented in another specific form without changing the technical spirit or an essential feature thereof.

Accordingly, it should be understood that the aforementioned exemplary embodiments are described for illustration in all aspects and are not limited, and the scope of the present disclosure shall be defined by the claims to be described below, and it should be construed that all of the changes or modified forms induced from the meaning and the scope of the claims, and an equivalent concept thereto are included in the scope of the present disclosure.

The hydraulic system for construction equipment according to the exemplary embodiment of the present disclosure may be used for controlling a hydraulic system, in which an exclusive pump/motor is provided to each actuator, so that the actuator is operated under control of the pump/motor.

What is claimed is:

1. A hydraulic system for construction equipment, comprising:

a pump/motor serving as both pump and motor;

an actuator provided with a first port and a second port, and operated by a working fluid provided from the pump/motor;

a first hydraulic line and a second hydraulic line connected with the first port and the pump/motor;

a third hydraulic line and a fourth hydraulic line connected with the second port and the pump/motor;

a first logic valve disposed in the first hydraulic line and the second hydraulic line; and a second logic valve (120) disposed in the third hydraulic line and the fourth hydraulic line, wherein when a first pressure of a higher pressure side between the first port and the second port is larger than a second pressure of the pump/motor, the pump/motor is operated from a time point, at which an operating unit is operated, so that the first pressure and the second pressure are controlled to be the same before the first and second logic valves are opened.

2. The hydraulic system of claim 1, wherein when a first direction, in which a load is applied to the actuator, and a second direction, in which the actuator is desired to be operated, are defined, and the first direction corresponds to the second direction, an opening time point of the first and second logic valves is controlled to be advanced compared to a case where the first direction is different from the second direction.

3. The hydraulic system of claim 1, wherein when the pump/motor is operated to increase the second pressure, a flow quantity of the working fluid is controlled to be discharged at a maximum value for a pressure/flow quantity compensation time.

4. The hydraulic system of claim 1, wherein when the pump/motor is operated to increase the second pressure, a leakage compensation flow quantity is controlled to be discharged at a maximum value for compensating for leakage of the working fluid.

5. The hydraulic system of claim 4, further comprising:

relief valves in the second and fourth hydraulic lines so that the second pressure is maintained at set pressure.

6. A hydraulic system for construction equipment, comprising:

a pump/motor serving as both pump and motor;

an actuator, of which an inlet port and an outlet port are connected with the pump/motor through a hydraulic line;

first and second logic valves installed on the hydraulic line so as to open or close the hydraulic line; and a control unit configured to control the first and second logic valves to be opened or closed according to an operation signal for the actuator, wherein when the control unit operates the actuator in an opposite direction to a direction, in which a load is applied to the actuator, the control unit delays an opening of the first and second logic valves until pressure is compensated in the hydraulic line between the pump/motor at a hydraulic pressure supply side and the first logic valve or the second logic valve.

7. The hydraulic system of claim 6, wherein when the control unit operates the actuator in the same direction as a first direction, in which a load is applied to the actuator, the control unit controls an opening delay time of the first and second logic valves to be shorter than that of a case where the control unit operates the actuator in the opposite direction to the first direction.

8. The hydraulic system of claim 6, wherein an opening delay time of the first and second valves is up to a time at which pressure of the hydraulic line between the pump/ motor at a hydraulic pressure supply side and the first logic valve or the second logic valve is the same as pressure of the hydraulic line between the first logic valve or the second logic valve and the actuator.

9. The hydraulic system of claim 6, wherein pressure of the hydraulic line between the pump/motor and the first logic valve or the second logic valve is compensated by hydraulic pressure discharged from the pump/motor.

10. The hydraulic system of claim 6, further comprising:

relief valves on the hydraulic lines connecting the first and second logic valves and the actuator so as to maintain set pressure.

* * * * *